US005191660A

United States Patent [19]

Francke

[11] Patent Number: 5,191,660

[45] Date of Patent: Mar. 9, 1993

[54] DEVICE FOR ATTACHING A TOILET ELEVATOR TO THE BOWL OF A TOILET

[75] Inventor: Kurt Francke, Tyresö, Sweden

[73] Assignee: Rfsu Rehab AB, Stockholm, Sweden

[21] Appl. No.: 789,877

[22] Filed: Nov. 12, 1991

[30] Foreign Application Priority Data

Nov. 12, 1990 [SE] Sweden ..... 90036039

[51] Int. Cl.[5] ..... A47K 13/00; A47K 13/04

[52] U.S. Cl. ..... 4/239; 4/248; 4/DIG. 8; 297/440; 403/97

[58] Field of Search ..... 4/235, 237, 239, 246.3, 4/246.5, 248, DIG. 8, 253; 297/440; 403/97; 269/9, 59, 10, 315; 220/287

[56] References Cited

U.S. PATENT DOCUMENTS

| | | | |
|---|---|---|---|
| 677,799 | 7/1901 | Robinson | 4/239 |
| 755,183 | 3/1904 | Spanjer | 4/239 |
| 762,512 | 6/1904 | Busse | 4/239 X |
| 2,598,577 | 5/1952 | Mattison | 4/237 |
| 2,609,251 | 9/1952 | Haupt | 403/97 |
| 2,687,535 | 8/1954 | Almorth | 4/239 |
| 3,317,225 | 5/1967 | Cooper | 403/97 X |
| 3,364,505 | 1/1968 | Palmier | 4/239 |
| 3,490,082 | 1/1970 | Murcott | 4/239 |
| 3,495,277 | 2/1970 | Herskovich | 4/237 |
| 3,626,600 | 12/1971 | Gaither | 269/10 X |

FOREIGN PATENT DOCUMENTS

| | | | |
|---|---|---|---|
| 0240405 | 8/1960 | Australia | 4/239 |
| 0508454 | 10/1920 | France | 403/97 |

*Primary Examiner*—Henry J. Recla
*Assistant Examiner*—Robert M. Fetsuga
*Attorney, Agent, or Firm*—Young & Thompson

[57] ABSTRACT

An arrangement for detachably holding seats (2) to the bowls of water-flushed toilets and comprising a number of arms (10) which can be adjustably attached to the underside of the seat (2). The free outer ends of the arms (10) are provided with pins (11) which can be locked in positions against the outside of the bowl rim of the toilet when the seat (2) is placed in position on the bowl. The arms (10) are pivotally mounted and can be locked in selected positions. The pins (11) are provided with a sleeve (12) of rubber or plastic material which generates a frictional force in contact with the toilet bowl. The arms (10) pivot around a screw (19) which is screwed into the underside of the toilet seat (2) and which in one position enables the arm (10) to be adjusted positionally and in another position locks the arm. The head (20) of the screw (19) is preferably covered with a coating (23) of rubber or plastic material and forms a cushion which rests on the toilet bowl when the toilet seat (2) is in its position of use.

12 Claims, 3 Drawing Sheets

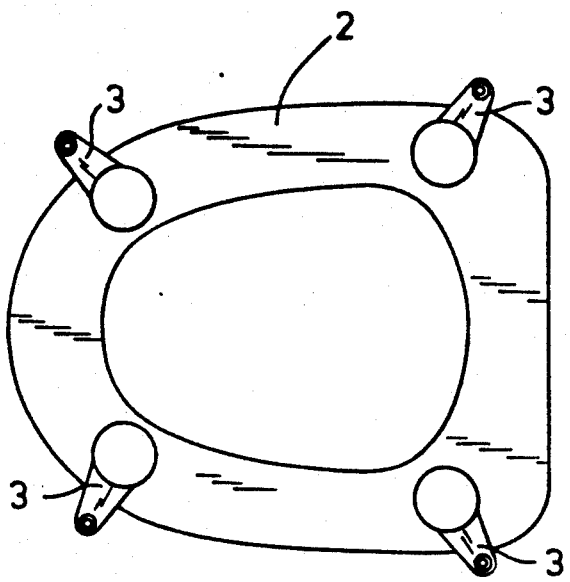
Fig. 2
Fig. 3
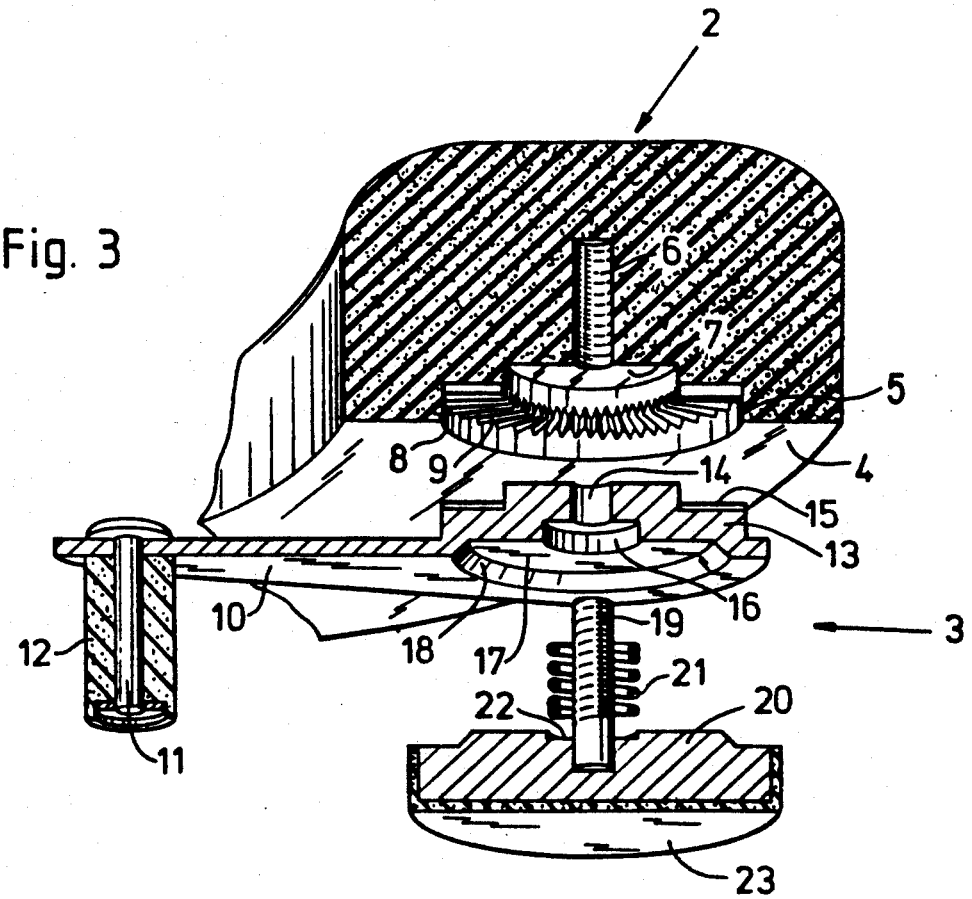

DEVICE FOR ATTACHING A TOILET ELEVATOR TO THE BOWL OF A TOILET

The present invention relates to a device for raising or elevating the seat or bowl level of a water-flushed toilet or water closet, hereinafter referred to as a toilet elevator, and more particularly, but not exclusively, to a toilet elevator attachment device which can be readily adjusted and which functions to reliably secure the elevator to the bowl of a toilet.

There are many occasions when the functional needs of handicapped people are facilitated by the use of a toilet bowl elevator, particularly when conventional toilets for handicapped people are not available, for example when temporarily visiting places other than normal, routine places. Such toilet elevators should be light in weight and easy to keep clean, so that they can be carried by the handicapped person without problem. It should also be possible to adjust the toilet elevator to conform to the different types of toilet bowls found.

Many different types of toilet elevators are known to the art, both in the form of loose toilet bowl elevators, which are placed on top of the standard toilet bowl, and in the form of thick seats. The loose toilet bowl elevators are bulky and may be found difficult to position correctly in conventional, confined toilets. Such elevators are also difficult to carry and to stow away when not in use. The loose seats have hitherto preferably been provided with holders or fixing devices of a kind which are intended always to form a more or less permanent fixture on the toilet bowl and also have the disadvantage of being individually adapted to toilet bowls of different manufacture, which requires the provision of a large number of different attachment devices and, in certain cases, also different basic designs of the actual seat itself.

In recent times, however, a number of toilet elevators have been introduced in the form of loose seats provided with devices for attaching the seats to different types of toilet bowls. The drawback with these known loose seats, however, is that the attachment devices are difficult to manipulate and have a form such as to render it extremely difficult to keep the devices clean. In the case of a handicapped person, it is important that the attachment devices can be adjusted easily and that the devices can be locked positively without requiring excessive force. Thus, known attachment devices include grooves on the underside of the seat, and the settings of the attachment devices are adjusted with the aid of members which are pushed forwards and backwards in said grooves and locked in position with the aid of wing nuts. It will readily be seen that such designs will collect dirt and are difficult to lock in position.

Furthermore, in some cases, it is difficult to maintain the known toilet elevators firmly in position, when a person using the toilet seats himself/herself on the toilet seat. It will be observed in this respect that it is not always possible for a handicapped person to seat himself/herself readily on a toilet seat, but is necessitated to slide onto the seat or to hop onto the seat in some way or another. The seat must therefore remain firmly in position, despite the large forces to which it is subjected. Notwithstanding this, the seat must also be light in weight and easy to fit in position on the toilet bowl and easy to remove therefrom. As before mentioned, it is also essential that devices of this kind can be easily kept clean, and consequently the elevator attachment devices must be of simple construction and have smooth and plain surfaces.

The object of the present invention is to overcome the aforesaid problems. This object is achieved with a toilet-seat attachment device of the kind defined in the Claims, in which the characteristic features significant of the invention are set forth.

The invention will now be described in more detail with reference to the accompanying drawings, in which FIG. 1 illustrates schematically and in perspective a water-flushed toilet fitted with a toilet bowl-elevating seat, which is partially transparent, provided with inventive seat attachment devices;

FIG. 2 shows the seat of FIG. 1 from beneath;

FIG. 3 is a section view of an inventive attachment device shown in connection with a fragmented, sectioned part of a toilet seat.

Figure 1:
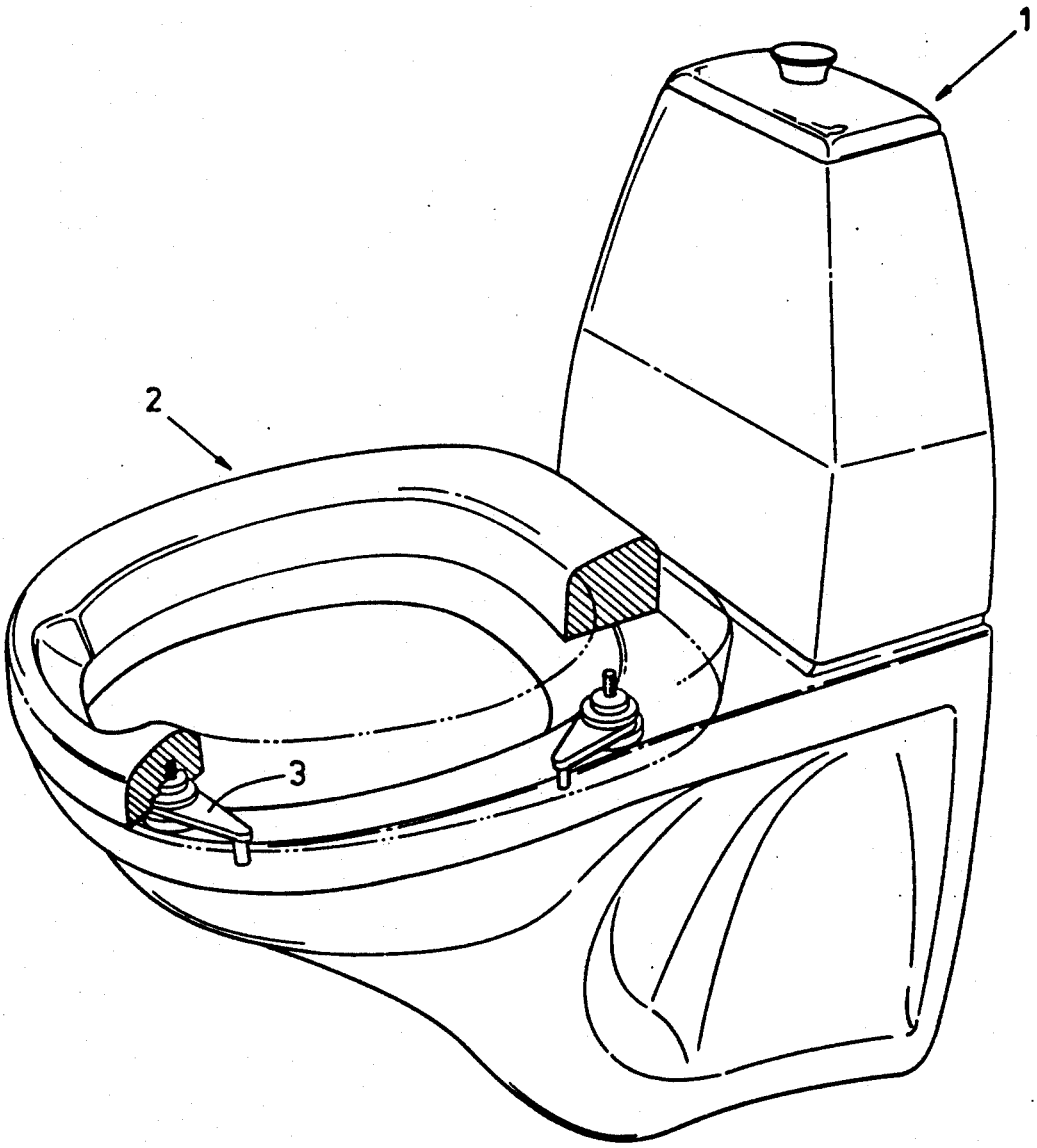

FIG. 1 illustrates schematically a typical toilet or water closet 1, from which the standard toilet seat has been removed and replaced with an elevated or raised seat 2. The seat 2 is provided with four inventive seat attachment devices 3, of which two are shown in the Figure. These attachment devices 3 can be adjusted in a manner which enables the seat 2 to be adapted to different types of toilet 1 or to different manufacturers of toilet 1, and therewith be held reliably in place.

FIG. 2 shows the toilet seat 2 from beneath, i.e. from the side which is intended to rest on the upper surface of the toilet bowl. This Figure also shows the four attachment devices 3. It will be understood that the seat may include more than four devices or fewer than four devices, although it has been found that four attachment devices 3 is a suitable number for the majority of toilets.

It is necessary for a seat attachment device 3 of the kind to which the invention pertains to possess certain technical qualities. Furthermore, the attachment device must be such as not to collect dirt or to be difficult to clean. It will be obvious from the following that the inventive attachment device truly satisfies these conditions.

The actual seat 2 itself, which constitutes a so-called toilet elevator and will therefore have a considerably greater thickness or height than a conventional toilet seat, is suitably manufactured from a plastic material. As illustrated in FIG. 3, the seat is preferably filled with, e.g., a foamed plastic at least at the locations of the attachment devices 3. Since the attachment devices 3 are of identical construction, only one attachment device will be described.

Provided in the underside 4 of the toilet seat 2, i.e. in that side of the seat 2 which shall face towards the toilet bowl, is an aperture 5 which is cross-section has essentially the shape of an inverse T. The innermost part of the aperture 5 consists in a screw-threaded part 6, which may conveniently comprise a sleeve that has been cast or moulded in the plastic material of the seat or attached therein in some other way. Externally of the part 6 is a circular recessed part 7, with the screw-threaded part 6 terminating in said recessed part. Provided externally of the recessed or sunken part 7 is a further recessed or sunken part 8, which is circular in shape and lies concentrical with both the recess 7 and the screw-threaded part 6. The latter recessed part 8 extends inwardly from the underside 4 of the seat 2 and its bottom is provided with radially extending ridges 9 of triangular cross-section.

An arm 10 has at one end thereof a downwardly extending pin 11 which is surrounded by a sleeve 12, made of rubber for instance. Provided on the other end of the arm 10 is a circular, disc-shaped part 13 whose one side, opposite to that from which the pin 11 extends, is complementary to the recesses 7 and 8 provided in the toilet seat 2. A hole 14 extends centrally through the disc-shaped part 13. That part of the disc-shaped part 13 which corresponds to the recess 8 in the seat 2 is provided with corresponding triangular-shaped ridges 15, which are similar to the earlier mentioned ridges 9.

The opposite side of the disc-shaped part 13 has an internal, circular recess 16 and an outer, circular recess 17, both of said recesses 16, 17 being concentrical with the penetrating hole 14. The outer recess 17 has an outer edge surface 18 which is inclined outwardly and inwardly.

A cylindrical screw 19 whose screw thread corresponds to the screw threaded part 6 in the seat 2 is mounted centrally in a knob 20. A helical pressure spring 21 is positioned around the screw 19. The knob 20 is provided with a circular recessed or sunken part 22 which surrounds one end of the screw 19 and receives one end of the spring 21. The outer surface of the knob 20 is covered appropriately with a covering 23 of rubber or corresponding material. The form interior configuration of the knob 20 is generally complementary to the form of the recessed part 17 of the disc-shaped part 13.

When the elevating device is fitted, the screw 19 is screwed into the screw threaded part 6, with the spring 21 clamped between the knob 22 and the disc-shaped part 13. In a first tightening position of the screw 19, the spring 21 is lightly tensioned and urges the disc-shaped part 13 into the recesses 7 and 8, the ridges 9 and 15 therewith being brought into light engagement with one another. When all seat retaining devices have been brought to this first position, the toilet seat 2 is placed in position on the bowl of the toilet or closet 1. As illustrated, it is immaterial whether or not the standard toilet seat has been removed or has simply been raised. If the arms 10 have not already been positioned so as to extend straight out from the toilet seat 2, the arms are then extended so that the seat will rest on the upper surface of the toilet bowl. The arms 10 are then swung manually in towards the outer surface of the toilet bowl, as shown in FIG. 1, so that the pins 11 press lightly there against.

Such adjustment is possible, because the spring 21 is only lightly tensioned, the ridges 9 and 15 moving over one another in a ratchet-like action. When the toilet seat 2 is lifted from the toilet bowl, the arms 10 will be kept in their set positions, as a result of the biassing force of the springs. When the knob 20 is turned such as to tighten the screw 19, this spring effect will disappear and the arms 10 will be locked in position in relation to the toilet seat 2.

The material from which the sleeve 12 surrounding the pin 11 is made is flexible and is highly frictional in relation to the porcelain from which the toilet bowl is made. When the seat 2 has been adjusted and returned to the toilet bowl, the seat is pressed down lightly, in order to overcome the frictional forces acting between the sleeve 12 and the porcelain. The seat 2 then remains firmly in position and the adjustability of the seat enables it to be fitted to the toilet irrespective of the shape of the rim of the bowl opening.

The form of the knob 20 is such that the knob will terminate tightly against the underside of the disc-shaped part 13 of the arm 10, said disc-shaped part, in turn, terminating tightly against the underside 4 of the toilet seat 2. The coating 23 on the knob 20 forms a cushion between the seat 2 and the toilet bowl, therewith assisting in the firmness with which the toilet seat rests against the toilet bowl when the seat is subjected to load.

Figure 4:
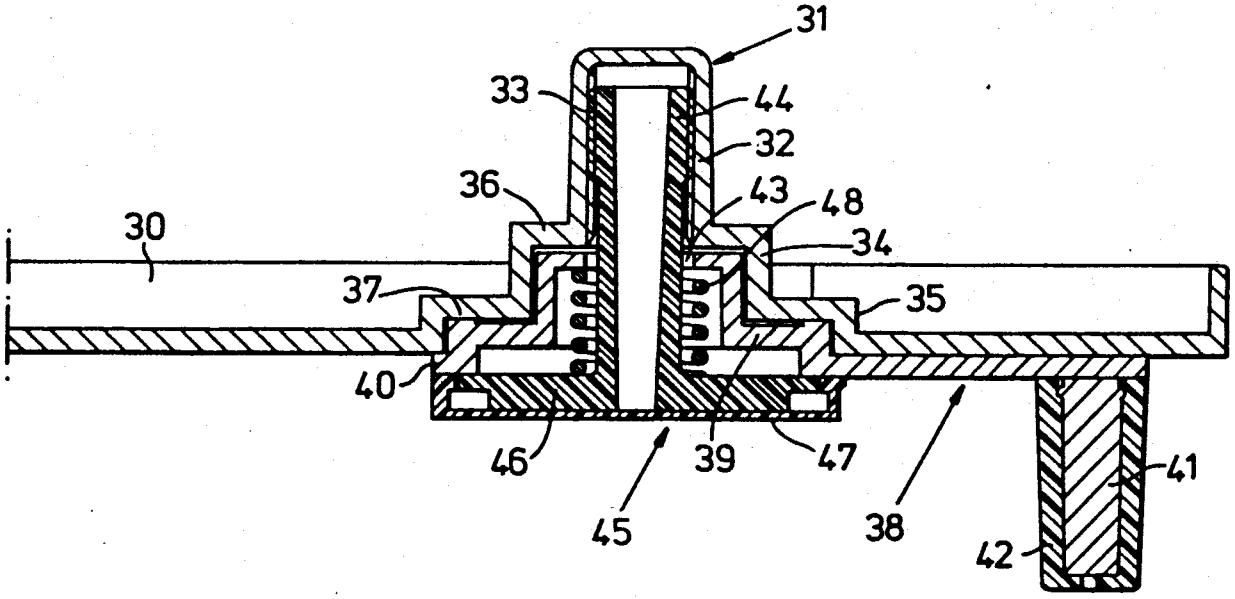
FIG. 4 is a fragmented view similar to FIG. 3 but showing a second embodiment of the inventive seat attachment device.

FIG. 4 illustrates another embodiment of the inventive seat attachment device, this device having essentially the same basic design as the device illustrated in FIG. 3. In the case of this embodiment, the inventive seat includes a bottom plate 30 having a recess 31 which is provided in conjunction with the manufacture of the plate 30. The recess 31 has a circular cross-section and comprises three mutually concentrical parts with diameters which increase from within and outwardly. The first, or the inner part 32 has the smallest diameter and is provided internally with a screw thread 33. The second, or intermediate part 34, has a slightly larger diameter than the inner part 32, and the third, or outer part 35, has still a larger diameter. The parts 32, 34 and 35 are mutually separated by ring-shaped steps 36, 37, which are generally horizontal in the use position of the elevator seat.

Provided on one end of an arm 38 is a part 39 whose shape is generally complementary to the intermediate part 34 and to the outer part 35 of the recess 31. The part 39 also has an edge 40 which projects slightly above the underside of the bottom plate 30 at the outer part 35 of the recess 31. Provided on the other, free end of the arm 38 is a pin 41 which extends substantially at right angles from the plane of the bottom plate 30 and over which a sleeve 42, made of rubber or a plastic material, is fitted.

Provided in the centre of the arm part 39 is a hole 43 through which a screw threaded stem 44 of a screw 45 extends. The screw 45, which in the illustrated embodiment has a tubular stem 44, is preferably made of a plastics material. The head 46 of the screw 45 forms a knob and is circular in shape and has a diameter generally similar to the diameter of the recess 31 in the outer part 35.

The head 46 is covered with a covering 47 of rubber or plastic material, which functions as a cushion against the toilet bowl when the seat is in position thereon, while covering a large part of the device, so that it can be easily kept clean. The covering 47 extends flush with the edge 40 of the part 39.

A pressure spring 48 is positioned around the screw stem 44 and extends between the inside of the screw head 46 and the bottom of the inner part of the part 39. This spring 48 functions to press the part 39 inwards in the same manner as that described with regard to corresponding components of the FIG. 3 embodiment. The step 37 separating the parts 34 and 35 is provided with radially extending ridges, preferably of triangular cross-section, and that portion of the part 39 which faces said step has corresponding ridges such that mutual engagement of the ridges can be obtained in the same manner as that described with reference to the FIG. 3 embodiment.

The toilet seat 2 can be cleaned, simply by lifting-up the seat and rinsing the same. The seat includes no dirt-collecting crooks or crannies, etc. and is therefore easily kept clean. The seat requires no further adjustment when placed back in position on the toilet bowl.

It will be seen that the present invention fulfils the object described in the introduction. It will also be understood that the described and illustrated embodiments of the invention can be modified by one skilled in this art, although such modifications or changes will naturally lie within the scope of the invention as defined in the following claims.

I claim:

1. A device for detachably holding toilet seats (2) on the bowls of toilets or water closets (1), said device comprising a plurality elongate of arms (10, 38) adapted to be fitted to the underside (4) of the seat (2), said arms (10, 38) being pivotal about an axis and capable of being locked in selected pivotal positions, wherein one end of each respective arm is provided with a pin (11, 41) which depends there from at a generally right angle to the arm (10, 38), said pins (11, 41) being intended to rest against the outer surface of the rim of a toilet bowl when the seat (2) is placed in a position of use on said bowl, each of said arms (10, 38) having at its other end a circular disc-shaped part (13, 39) protruding therefrom having a centrally located aperture (14, 43) therethrough, said part (13, 39) adapted to being received in a complementary recess (8, 31) in the underside (4) of the seat (2); a stem of a screw (19, 45) extending through the central aperture (14, 43) for engaging a screw threaded part (6, 33) in the toilet seat (2) and defining said pivot axis, wherein tightening of the screw (19, 45), with a head (20, 46) of said screw engaging the lower surface of the disc-shaped part (13, 39), locks the arm (10, 38) in its adjusted position; and, mutually coacting engagement devices (9, 15) arranged on the mutually engaging surfaces of the recess (8, 31) and the circular, disc-shaped part (13, 39).

2. An arrangement according to claim 1, characterized in that the circular, disc-shaped part (39) is constructed in concentrical steps.

3. An arrangement according to claim 2, characterized in that the coacting engagement devices (9, 15) comprise radially extending ridges on the respective engaging surfaces; and in that a spring (21, 48) is mounted between the screw head (20, 46) and the disc-shaped part (13, 39) and functions to bias the arm (10, 38) towards a locked position by engagement between the ridges (9, 15), wherein in a first spring biassing position (21, 48) the ridges (9, 15) are able to ratchet over one another when rotating the arm (10, 38), and are locked in mutual engagement in a second biassing position of the spring (21, 48).

4. An arrangement according to claim 2, characterized in that the pin (10, 38) is surrounded by a sleeve (12, 42) made of rubber or plastic material.

5. An arrangement according to claim 2, characterized in that the screw head (20, 46), in the position of use of the toilet seat (2), rests against the upper edge surface of the bowl opening of the toilet or closet (1).

6. An arrangement according to claim 1, characterized in that the coacting engagement devices (9, 15) comprise radially extending ridges on the respective engaging surfaces; and in that a spring (21, 48) is mounted between the screw head (20, 46) and the disc-shaped part (13, 39) and functions to bias the arm (10, 38) towards a locked position by engagement between the ridges (9, 15), wherein in a first spring biassing position (21, 48) the ridges (9, 15) are able to ratchet over one another when rotating the arm (10, 38), and are locked in mutual engagement in a second biassing position of the spring (21, 48).

7. An arrangement according to claim 6, characterized in that the pin (10, 38) is surrounded by a sleeve (12, 42) made of rubber or plastic material.

8. An arrangement according to claim 6, characterized in that the screw head (20, 46), in the position of use of the toilet seat (2), rests against the upper edge surface of the bowl opening of the toilet or closet (1).

9. An arrangement according to claim 1, characterized in that the pin (10, 38) is surrounded by a sleeve (12, 42) made of rubber or plastic material.

10. An arrangement according to claim 9, characterized in that the screw head (20, 46), in the position of use of the toilet seat (2), rests against the upper edge surface of the bowl opening of the toilet or closet (1).

11. An arrangement according to claim 1, characterized in that the screw head (20, 46), in the position of use of the toilet seat (2), rests against the upper edge surface of the bowl opening of the toilet or closet (1).

12. An arrangement according to claim 11, characterized in that the screw head (20, 46) is covered with a covering (23, 47) of rubber or plastic material.

* * * * *